US008851324B2

(12) United States Patent
O'Sullivan

(10) Patent No.: US 8,851,324 B2
(45) Date of Patent: Oct. 7, 2014

(54) DRINKING CUP WITH A STRAW CONNECTED TO THE BOTTOM OF THE CUP

(71) Applicant: Sean Patrick O'Sullivan, Lee's Summit, MO (US)

(72) Inventor: Sean Patrick O'Sullivan, Lee's Summit, MO (US)

( * ) Notice: Subject to any disclaimer, the term of this patent is extended or adjusted under 35 U.S.C. 154(b) by 0 days.

(21) Appl. No.: 13/874,685

(22) Filed: May 1, 2013

(65) Prior Publication Data

US 2013/0240545 A1 Sep. 19, 2013

Related U.S. Application Data

(63) Continuation-in-part of application No. 29/434,291, filed on Oct. 11, 2012, now abandoned, which is a continuation-in-part of application No. 29/412,858, filed on Feb. 8, 2012, now abandoned.

(60) Provisional application No. 61/640,956, filed on May 1, 2012.

(51) Int. Cl.
*A47G 19/22* (2006.01)

(52) U.S. Cl.
CPC ..... *A47G 19/2222* (2013.01); *A47G 19/2266* (2013.01)
USPC ..... 220/710

(58) Field of Classification Search
CPC ..... A47G 16/2266; A47G 19/2222; A47G 19/2205; B65D 77/286; B65D 77/28; B65D 81/3869; B65D 81/3867; B65D 81/3872; B65D 81/3865
USPC ..... 220/710, 705, 756, 752, 62.12, 62.18, 220/592.17, 592.16; 215/229, 228, 388; 16/425, 422, 430
See application file for complete search history.

(56) References Cited

U.S. PATENT DOCUMENTS

| | | | | |
|---|---|---|---|---|
| 2,052,344 | A | 8/1936 | Edelmann | |
| 2,355,010 | A * | 8/1944 | Pera | 220/710 |
| 2,756,740 | A * | 7/1956 | Deane | 604/77 |
| 4,607,755 | A * | 8/1986 | Andreozzi | 224/482 |
| 5,005,717 | A * | 4/1991 | Oilar | 215/13.1 |
| 5,199,633 | A * | 4/1993 | Jantzen et al. | 229/103.1 |
| 5,280,844 | A | 1/1994 | Kaufman et al. | |
| 5,325,982 | A * | 7/1994 | Cobb, Jr. | 220/212.5 |
| 5,597,089 | A | 1/1997 | Smith | |
| 5,702,020 | A | 12/1997 | Larsen | |
| 5,918,761 | A | 7/1999 | Wissinger | |
| 6,070,767 | A | 6/2000 | Gardner et al. | |
| 6,199,729 | B1 * | 3/2001 | Drzymkowski | 224/148.2 |
| 6,321,977 | B1 | 11/2001 | Lee | |
| 6,364,168 | B1 | 4/2002 | Gardner et al. | |
| 6,497,348 | B2 | 12/2002 | Forsman et al. | |
| 6,527,137 | B1 | 3/2003 | Kleckauskas et al. | |
| 6,742,681 | B1 | 6/2004 | Yang | |
| 7,147,121 | B2 | 12/2006 | Boucher et al. | |

(Continued)

*Primary Examiner* — Robert J Hicks
(74) *Attorney, Agent, or Firm* — Erickson Kernell Derusseau & Kleypas, LLC

(57) ABSTRACT

A drinking cup for use by individuals in reclined position is disclosed. The cup includes a flexible straw attached to the base of the cup, a lid, and a handle with a groove for receiving and storing the straw. A bight actuated mouthpiece valve is connected to the distal end of the straw. The cup may be of double walled construction and the lid includes a small hole to release any vacuum created as a user sucks on the straw.

19 Claims, 7 Drawing Sheets

(56) References Cited

U.S. PATENT DOCUMENTS

| | | | | |
|---|---|---|---|---|
| 7,204,385 | B2 | 4/2007 | Rockhill et al. | |
| D547,606 | S | 7/2007 | Forsman | |
| 7,533,783 | B2 | 5/2009 | Choi et al. | |
| 2002/0092877 | A1 | 7/2002 | Bowman | |
| 2005/0006396 | A1* | 1/2005 | Unkenholz | 220/710 |
| 2005/0242204 | A1* | 11/2005 | Ness et al. | 239/24 |
| 2005/0274722 | A1* | 12/2005 | Vilchez et al. | 220/4.27 |
| 2007/0034594 | A1 | 2/2007 | Doucet et al. | |
| 2008/0006644 | A1 | 1/2008 | Toth et al. | |
| 2010/0302897 | A1* | 12/2010 | George et al. | 366/130 |
| 2011/0062153 | A1* | 3/2011 | Wang | 220/23.86 |
| 2011/0062154 | A1 | 3/2011 | Rhee | |
| 2011/0108613 | A1 | 5/2011 | Stribling et al. | |

* cited by examiner

DRINKING CUP WITH A STRAW CONNECTED TO THE BOTTOM OF THE CUP

CROSS-REFERENCE TO RELATED APPLICATIONS

This application is a continuation-in-part of and claims priority from application Ser. No. 29/434,291 filed Oct. 11, 2012, which is a continuation-in-part of application Ser. No. 29/412,858, filed Feb. 8, 2012, now abandoned. This application claims priority from provisional patent application No. 61/640,956 filed May 1, 2012, the contents of which are incorporated herein by reference.

BACKGROUND OF THE INVENTION

1. Field of the Invention

This invention relates to drinking cups. More specifically, it relates to drinking cups which allow a user to readily drink from a cup while in a reclined or supine position.

2. Background & Description of the Related Art

Drinking cups come in many different shapes, sizes and configurations. Cups are most commonly used as receptacles for storing beverages for consumption. A conventional configuration for a cup comprises a flat base with a cylindrical side wall extending upward from the base and ending in a rim which frames the cup opening or mouth. To drink from a conventional cup, a person puts the rim of the cup to their mouth and tilts the cup to dispense the liquid over the rim. Lids, secured across the rim of a cup, are often employed to resist spills thereby requiring use of a straw to allow the drinker to suck the fluid contents out of the cup.

Drinking from a conventional cup with or without a straw is difficult or impossible to manage for bedbound individuals or other persons incapable of sitting up from a reclining to an upright position. Although bendable or flexible straws could be used, such straws would need to be longer than conventional straws to reach from the bottom of the cup, over the rim, out of the cup and back down to the drinker's mouth positioned below at least the rim of the cup and likely below the bottom of the cup such. The portion of the straw extending out of the cup would need to be longer than the portion in the cup. If such a long straw is not secured to the cup, it would tend to fall out of the cup either while the user is attempting to drink from the cup or when the cup is not in use. Such a straw would be prone to being lost and it would be difficult difficult to prevent the end of the straw from touching unsanitary surfaces when not in use. In addition, the length of such a straw, if secured to the cup, would make the cup more difficult to store.

It is known to connect a flexible straw to an outlet formed through the base of a cup as shown in U.S. Pat. App. Pub. No. 2005/0006396 to Unkenholz and to form a clasp on the cup for connecting the straw thereto when not in use. Connecting the straw to the bottom of the cup allows gravity feeding of the contents of the cup through the straw and takes advantage of the head pressure created by the height of the liquid in the cup to facilitate drinking through the straw, which is particularly beneficial for users who may not be readily able to suck through a straw. A plug, which can be inserted in the distal end of the straw when not in use, is tethered to the side of the cup or the straw can be folded over itself and secured in place in the clasp to prevent liquid from flowing out of the distal end when not in use. The clasp disclosed by Unkenholz for securing the straw in place is problematic in that it is readily prone to snapping off or breaking, thereby eliminating the means for securing the straw to the body of the cup.

Double walled, thermally insulated cups have also become popular. The second wall is generally separated from the first wall by a thin layer of air. This wall, air, wall assembly generally provides adequate insulation for slowing heat transfer to or from the liquid contents. The double wall configuration also prevents the outside of the cup from becoming excessively hot or cold. An excessively cold outer wall could lead to condensation on the outside of the cup, thus making the cup slippery or uncomfortable to hold. U.S. Pat. App. Pub. No. 2011/0062153 to Rhee discloses a cup with a double wall structure. However, it was not heretofore known to connect a straw to a double walled cup near the bottom thereof to obtain the benefits of such a bottom draining cup in combination with an insulated cup.

SUMMARY OF THE INVENTION

The present invention comprises a cup from which a person can drink without having to tilt or lower the rim of the cup to mouth level to permit drinking from the cup while in a reclined or supine position. The cup comprises a cup body having a base and a side wall. The side wall extends upward from the base and surrounds an interior cavity for holding liquid. An outlet is formed through the base in flow communication with the interior cavity. A flexible straw is connected to the cup body in flow communication with the interior cavity through the outlet. A handle attached to the cup body is shaped to receive the flexible straw and releasably secure the flexible straw thereto.

An inner end of the straw is removably secured to a barbed nipple which is flow connected to an outlet passageway formed in the base of the cup. The barb is preferably positioned within a recess formed in the base of the cup to avoid breaking off of the nipple and for a cleaner appearance.

The handle includes a grip having a semi-circular recess formed therein with a diameter closely approximating the outer diameter of the flexible straw. The arc length of the recess formed in the grip is greater than one hundred and eighty degrees to hold the straw therein but the resulting gap is large enough to facilitate insertion and removal of the straw therefrom.

The cup preferably includes a lid removably securable to an upper end of the body to prevent spilling of the contents. A vent hole is provided in the lid to facilitate sucking the contents of the cup cavity out through the straw. A bite actuated valve is formed in a mouthpiece connected to an outlet end of the flexible straw. The bite actuated mouthpiece is advanceable from a normally closed alignment, preventing liquid from flowing out the outlet end of the flexible straw, to an open alignment when squeezed to allow liquid to flow out the outlet end of the flexible straw.

The cup body preferably utilizes a double wall configuration and has an inner cup shell and an outer cup shell. The inner cup shell includes a side wall connected to a base, and the side wall extends upwardly from the base to form the cavity for holding liquid. Similarly, the outer cup shell includes a side wall connected to a base, with the side wall extending upward from the base to form a cavity in which the inner cup is received. In addition to the benefit of thermal insulation, the invention's double wall design allows the inner cup to be easily and quickly separated from the outer cup for cleaning. The body may be made from a clear plastic to facilitate viewing of the level of contents thereon or of a sheet with designs, logos or indicia printed thereon positioned between the inner and outer cup side walls.

DETAILED DESCRIPTION OF THE PREFERRED EMBODIMENTS

Figure 1:
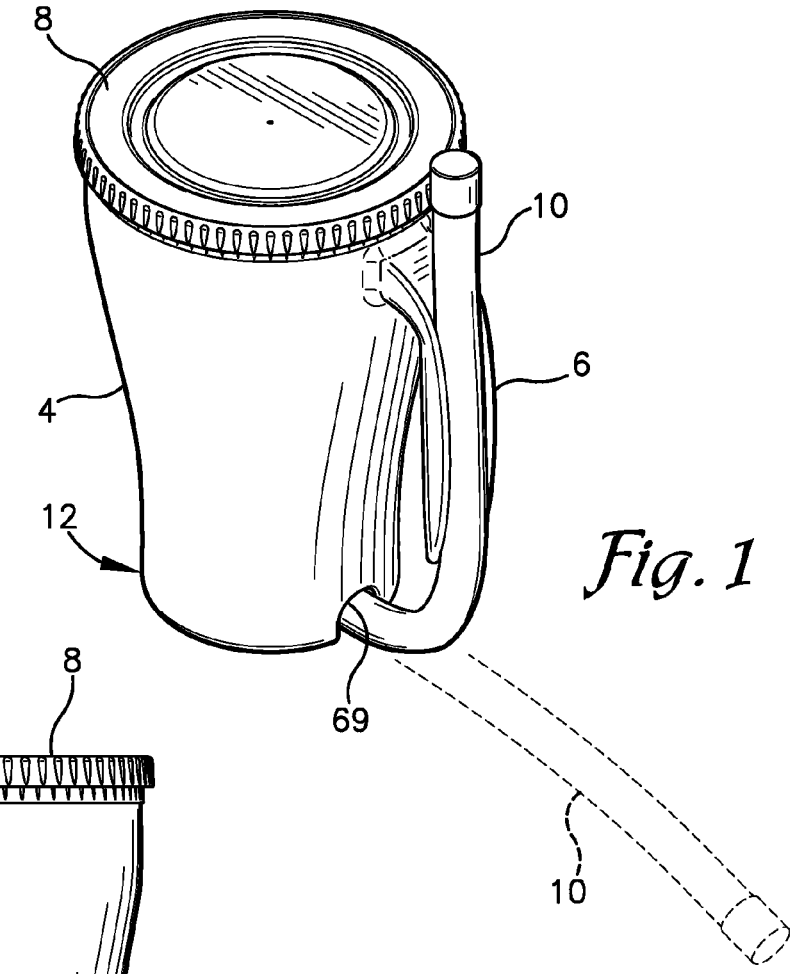
FIG. 1 is a perspective view of a drinking cup with a lid and a straw connected to the bottom of the cup and showing the straw in solid lines secured to the cup handle and in phantom lines disconnected from the handle and positioned for use by a person using the cup in a reclined position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, reference numeral 1 refers to a drinking cup or cup assembly 1 of the present invention. The drinking cup 1 includes a cup body 4, a handle 6, a lid 8 and a straw 10 flow connected to the cup body 4 near a base 12 thereof. Straw 10, in the embodiment shown, is a tube or hose formed from flexible elastomeric or plastic material such as latex or silicone. It is foreseen that a straw formed from a more rigid plastic with corrugations to permit or facilitate bending could also be utilized.

The embodiment of the cup 1 shown in FIGS. 1-6, comprises a body 4 of double walled construction formed from an inner cup 17 removably securable within an outer cup 19. The inner and outer cups 17 and 19 are preferably formed from a relatively rigid and clear plastic which is microwavable and dishwasher safe and which is readily sterilizable.

The outer cup 19 includes a bottom or floor 21 and a circumferential outer cup side wall or outer side wall 23. The outer side wall 23 is integrally formed with bottom 21 and extends upwardly therefrom ending at outer side wall rim 25. The outer cup side wall 23 is generally cylindrical, however in the embodiment shown, the side wall 23 tapers inward slightly toward the bottom 21. The circumference of the upper portion of the outer side wall 23 is slightly larger than that of the lower portion. An inner thread 26 is formed on a portion of the inner surface of the outer side wall 23 just below the rim 25 thereof.

The inner cup 17 includes a bottom or floor 29 and a circumferential inner cup side wall or inner side wall 31 which form or surround a cup cavity or chamber 32 for receiving beverages or other consumable fluids. The inner side wall 31 is integrally formed with floor 29 and extends upwardly therefrom ending at rim 33. The rim 33 on the inner cup 17 projects outward and extends over the rim 25 of the outer cup 19. Similar to the outer cup 19, the inner side wall 31 is generally cylindrical with an inward taper toward the floor 29. An outer thread 35 is formed on a portion of the outer surface of the inner side wall 31 just below the rim 33.

The inner cup 17 is threadingly secured within the outer cup 19 by inserting inner cup 17 into outer cup 19 and threading outer thread 35 into inner thread 26. The inner cup 17 is rotatably threaded into the outer cup 19 until the underside 37 of the rim 33 is seated on the outer side wall rim 25. When inner cup 17 is threadingly coupled to outer cup 19, the inner side wall 31 is offset from outer side wall 23 to form an air gap 40. The air gap 40 forms an insulating layer between the liquid in the cup and the air surrounding the cup. The inner side wall 31, air gap 40, and outer side wall 23 all form the double wall assembly that provides the thermal insulation benefits mentioned above. Similarly, a substantial portion of inner floor 29 is offset from outer floor 21 to form an air gap 41 therebetween. The inner floor 29, air gap 41, and outer floor 21 thermally insulate the bottom of the cup. A user may insert a thin flexible sheet (not shown), such as paper or a plastic sheet material with a design, image, picture, logo or indicia printed thereon, into the gap between the inner cup 17 and outer cup 19 to personalize the cup 1. The sheet is preferably sized to wrap around the inner cup side wall 31 but may only extend across a small portion of the inner cup side wall 31. For example, photographs or artwork incorporating team logos may be inserted in the gap between the inner and outer cups 17 and 19.

An elastomeric sealing member or O-ring 44 is secured around the outer surface of the inner cup side wall 31 just below rim 33 and above the outer thread 35 formed on side wall 31. The O-ring 44 is compressed against an inner surface of outer cup side wall 23 when inner cup 17 is threadingly secured within outer cup 19 forming a water tight seal therebetween.

Figure 3:
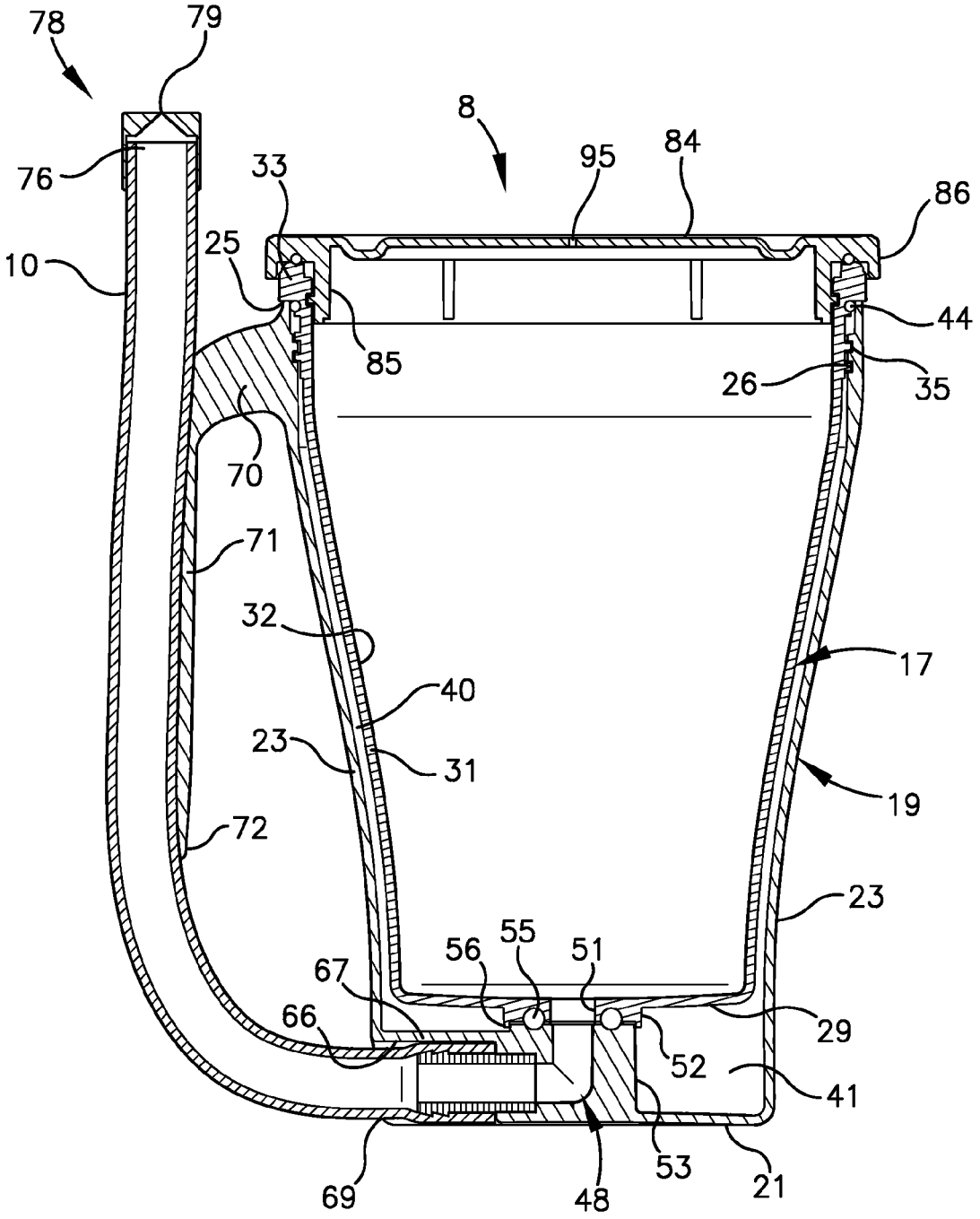
FIG. 3 is a cross-sectional view of the cup taken along line 3-3 of FIG. 2.
Figure 4:
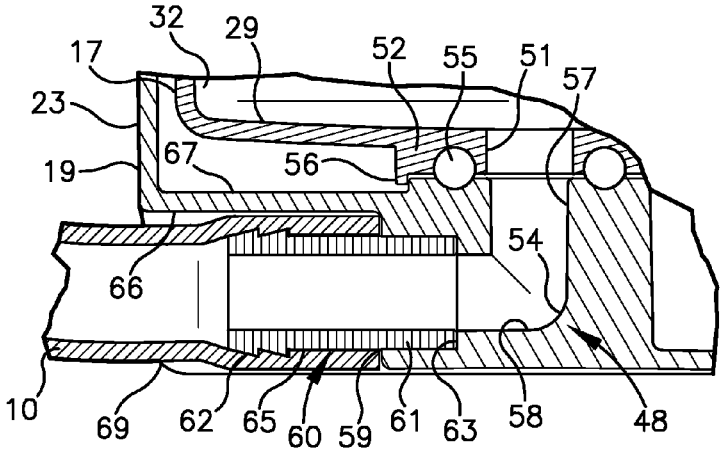
FIG. 4 is an enlarged and fragmentary cross-sectional view of a lower portion of the cup as shown in FIG. 3.

As best seen in FIGS. 3 and 4, an outlet conduit 48 is formed in and through the inner cup 17 and outer cup 19. Inner cup outlet opening 51 is formed through the center of floor 29 of inner cup 17 and surrounded by outlet hub 52. As shown in FIG. 3, inner floor 29 slopes slightly toward outlet 51 to aid in evacuation of the contents due to gravity. When the cup body 4 is not closed by lid 8, the contents may flow through outlet 51 in large part due to the force of gravity and the head pressure created by the height of the liquid in inner cup 17. When the cup body 4 is closed by lid 8 an additional vacuum force from a person sucking on straw 10 will also assist in moving the contents through outlet 51 and out through straw 10.

A mount or pedestal 53 with an outlet passageway 54 extending therethrough is formed on and projects upward from the floor 21 of the outer cup 19 for connection with the outlet hub 52 on inner cup 17 in flow communication therewith. An elastomeric O-ring 55 is secured within a groove formed in a bottom surface of outlet hub 52 around the outlet opening 51 of inner cup 17. The O-ring is pressed against an upper surface of the pedestal 53 around the outlet passageway 54 to form a water tight seal between the inner cup 17 and outer cup 19 around the inner cup outlet 51 and the outer cup outlet passageway 54. An annular rim or shoulder 56 projects downward from the outer periphery of outlet hub 52 of inner cup 17 and is positioned around the outer periphery of an upper end of the pedestal 53 when the inner cup 17 is threadingly secured within outer cup 19.

Outlet passageway 54 in outer cup 19 is formed as a cylindrical channel bored through or molded into pedestal 53. Outlet passageway 54 includes a ninety degree bend with a vertical leg 57 of the passageway 54 communicating with outlet 51 in inner cup 17 and a horizontal leg 58 extending to an outlet opening 59 of outer cup 19 which may also be referred to as the outlet end 59 of the pedestal 53. A hollow nipple 60 having a stem 61 and a barbed end 62 is press fit into the horizontal leg 58 of outlet passageway 54 with the stem 61 seating against a shoulder 63 formed in passageway 54. A first or inner end 65 of the flexible straw 10 is pressed onto and secured on the barbed end 62 of nipple 60 to couple straw 10 with flow passageway 54 which is flow connected to the interior or cavity 32 of inner cup 17 through inner cup outlet opening 51.

The barbed end 62 of nipple 60 and the associated coupled end 65 of straw 10 are concealed within a recess 66 formed in the outer cup floor 21. The recessed portion of the outer cup floor 21 forming recess 66 may be referred to as the straw connection housing 67. The housing 67 is in the form of a barrel vault running from the outer side wall 23 to the outlet end 59 of the pedestal 53. A straw outlet opening 69 is formed in outer side wall 23 along the base thereof. The bottom of the recess 66 is open to allow access to the straw connection nipple 60. Recessing the nipple 60 in recess 66 in outer cup floor 21 reduces the likelihood of accidentally breaking the nipple 63 or inadvertently disconnecting the straw 10 from the barbed end 62 of nipple 60.

A substantial portion of straw 10 is securable to the handle 10 as discussed hereafter. An upper end of handle 6 comprises a leg or stem 70 that is integrally formed with and connected to the outer side wall 23 of outer cup 19 below the rim 25. In the embodiment shown, the handle stem 70 is positioned in close proximity to the rim 25. A handle grip 71 projects downward from the handle stem 70 in spaced relation from the outer side wall 23 of the cup body 4. A lower end 72 of the handle 6 is not connected to the cup body 4 and is spaced above the straw outlet opening 69 through outer side wall 23. By leaving the bottom of the handle open, it is generally believed to be easier for a user to get a grasp on the handle grip 71 including individuals suffering from arthritis or who have difficulty in maneuvering their hands.

Figure 2:
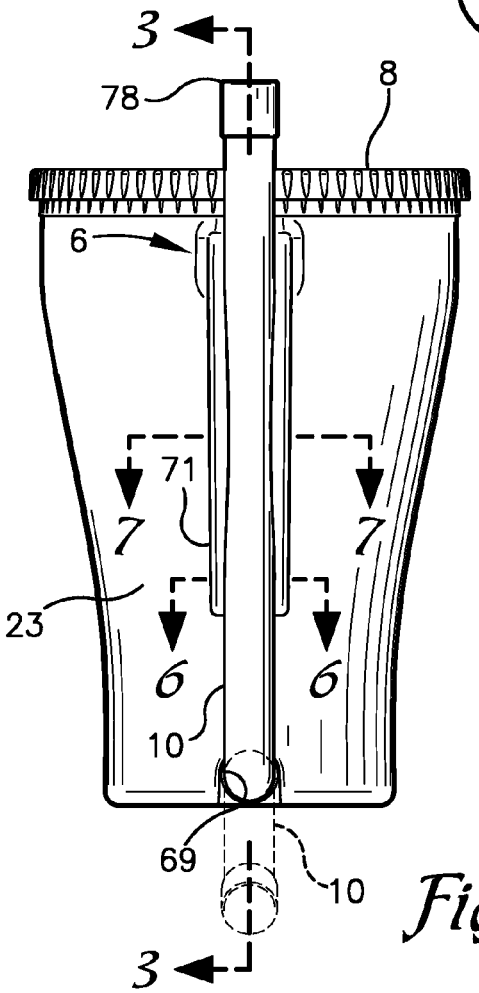
FIG. 2 is a rear view of the cup in FIG. 1.

As best seen in FIG. 2, the handle grip 71 is radially aligned with the straw outlet opening 69 formed in the outer side wall 23 of cup body 4. It is foreseen that the handle 6 could also be manufactured separately from the cup body 4 and then fastened to the outer side wall 23. It is also foreseen that both the upper and lower ends of the handle could be connected to the cup body 4. The user holds the cup by grip 71, which extends generally vertically.

Figure 6:
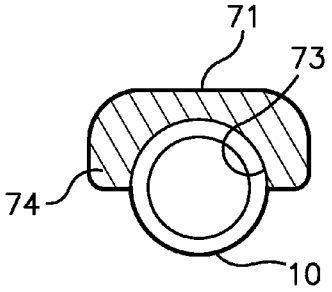
FIG. 6 is an enlarged cross-sectional view of a grip of the handle with the straw secured in a groove therein taken along line 6-6 of FIG. 2.
Figure 7:
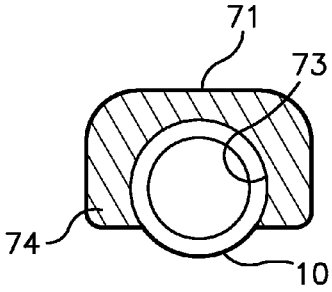
FIG. 7 is an enlarged cross-sectional view similar to FIG. 6 taken along line 7-7 of FIG. 2.

Referring to FIGS. 1-3, 6 and 7, a straw receiving groove or recess 73 is formed in an outer face of and extends axially along the handle grip 71. The straw receiving groove 73 is preferably semi-circular and sized to receive the flexible straw 10 therein when not in use so that the straw 10 can be stored vertically against grip 71. The straw receiving groove 73 has a cross sectional shape (cut horizontally across grip 71) of an arc measuring more than one hundred eighty degrees along at least a portion of the grip 71. As seen in FIGS. 2, 6 and 7, the arc of groove 73 is greater near the center of the grip 71 and smaller toward the ends. The arc of the groove increases from the ends toward the center such that the edges of the grip 71 forming the edge of the groove 73 slope or angle inward from the ends toward the center of the grip 71. At the ends of the grip 71, the arc of the groove 73 formed therein is close to 180 degrees and near the center the arc is approximately 250 degrees. A maximum arc of approximately 230 to 270 degrees is preferred and a maximum arc of approximately 245 to 255 degrees is believed to be most effective for holding the straw 10 in place while still allowing relatively easy insertion and removal of the straw 10 from the handle 6 by a user. As shown in FIG. 7, near the center of the grip 71 portions of side walls 74 of the handle grip 71 forming groove 73 extend over and across portions of the straw 10 positioned in the groove 73.

The radius of the groove 73 may be slightly smaller than the radius of an un-compressed outer wall of straw 10. Straw 10 is sufficiently flexible and resilient to compress as it is pressed into groove 73 and it then decompresses at least partially when seated in the recess. The inner surface of the portion of the grip 71 forming groove 73 surrounds the circumference of straw 10 by more than 180 degrees thus securing the straw 10 in or against the grip 71 in a stored position. The straw 10 can be readily removed from the grip 71 by pulling the straw 10 outward therefrom. A user can drink from the straw in the stored position but the straw 10 will typically be removed from the grip and oriented downward by the user, such as generally shown in dashed lines in FIG. 1, to facilitate drinking from a reclined position. As used herein, a reclined position is intended to include both fully reclined, or horizontal, and partially reclined positions.

Installed on the outlet or distal end 76 of straw 10 is a bite actuated valve or mouthpiece 78. As best seen in FIG. 3, valve 78 is made of flexible and resilient material that returns to its fabricated or resting shape after being deformed due to external force. Valve 78 includes a slit 79 formed therein that is normally closed. When a user bites down on the valve 78 or a downward force is otherwise applied to valve 78 the material forming valve 78 deforms to open slit 79. When the force is removed the mouthpiece or valve 78 returns to its resting shape and slit 79 closes. The mouthpiece valve 78, normally prevents the flow of the contents of the cup 1 out through the straw 10.

Lid 8 covers the mouth of the cup to prevent the contents of the cup from inadvertently spilling out of the cup 1. The lid 8 may be removed to fill or quickly empty the cup 1 or to allow for cleaning of the cup 1. In the embodiment shown, the lid 8 is secured to the cup 1 by a threaded connection. The lid 8 includes a cover panel 84, a downwardly projecting annular stem 85 and a downwardly projecting annular grip 86 spaced outward from stem 85. The outer surface of annular grip 86 is textured to aid in gripping the lid 8.

Figure 5:
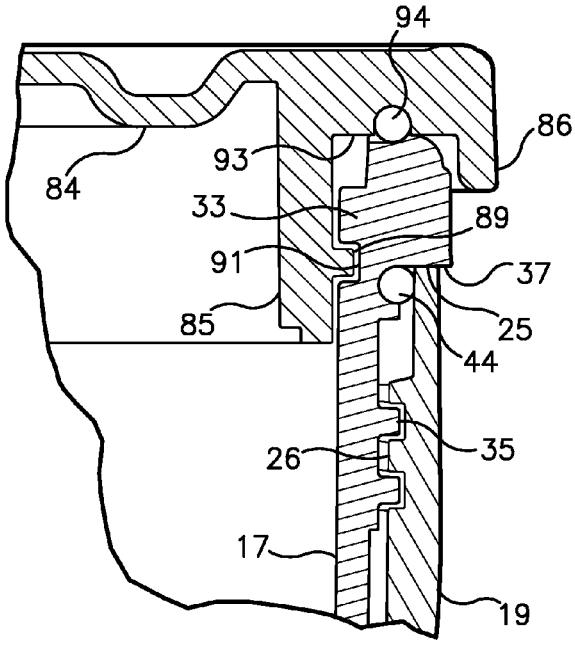
FIG. 5 is an enlarged and fragmentary cross-sectional view of an upper portion of the cup as shown in FIG. 3.

As best seen in FIG. 5, thread 89 is formed on an outer surface of the annular stem 85 of lid 8 and mates with a thread 91 formed on an inner surface of the inner cup 17 proximate rim 33 for securing lid 8 to cup body 4. To secure lid 8 to the cup, a user rotates the lid 8 until the underside 93 of the lid cover panel 84 is seated on rim 33. An elastomeric O-ring 94 is positioned in a groove formed in the underside 93 of the lid cover panel 84 between the stem 85 and grip 86. O-ring 94 engages an upper surface of rim 33 when the underside 93 of lid cover panel 84 is seated on rim 33 to form a water tight seal to prevent the contents of the cup 1 from leaking thereacross.

An air hole 95 is formed through the lid cover panel 84 to allow air into the cup to replace the volume of the contents removed from the cup 1 during drinking. The air hole 95 prevents a vacuum from forming which would inhibit sucking the contents from the cup through the straw 10. The hole is sized small enough to resist flowing of liquid therethrough, due to surface tension, if the cup 1 is inadvertently tipped over.

Although the straw 10 is shown as extending through an outlet opening 69 formed in the outer cup side wall 23, it is foreseen that the straw could extend downward from the bottom of the cup. As used herein, the base generally includes the structure of the cup 1 extending from and below the bottom panel 29 of the inner cup 17.

Although the outlet opening 69 in the cup body 4 through which the straw extends is shown positioned below a lower end of the handle, it is foreseen that the handle could extend below the outlet opening 69 with the straw extending through an opening formed in the handle. In addition, it is foreseen that the straw receiving groove could be formed in structure other than a handle or handle grip. For example a groove for receiving the straw could be formed in the outer cup side wall 23 or a ridge formed on the outer surface of the side wall 23.

Figure 8:
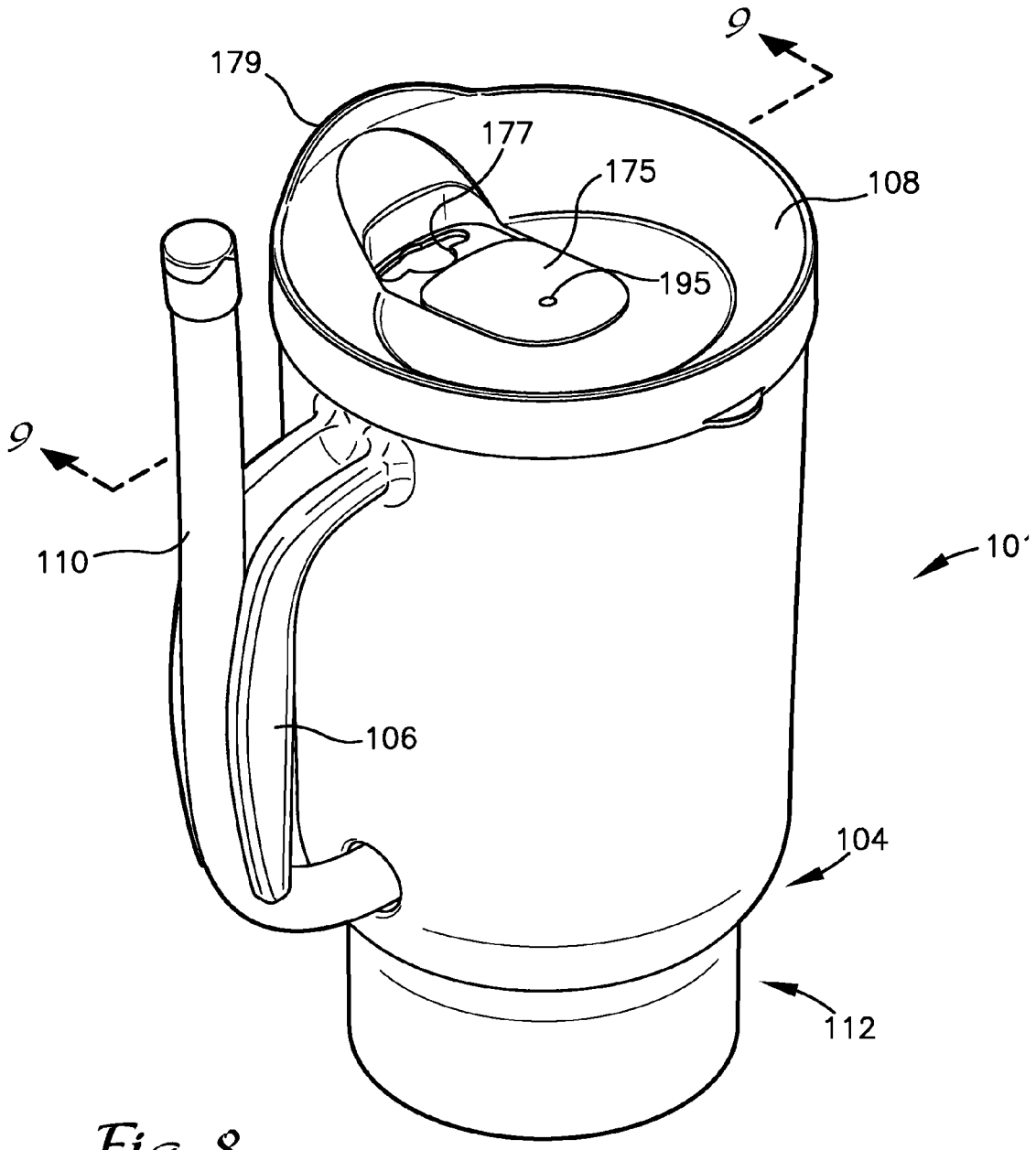
FIG. 8 is a perspective view of an alternative embodiment of the cup.
Figure 9:
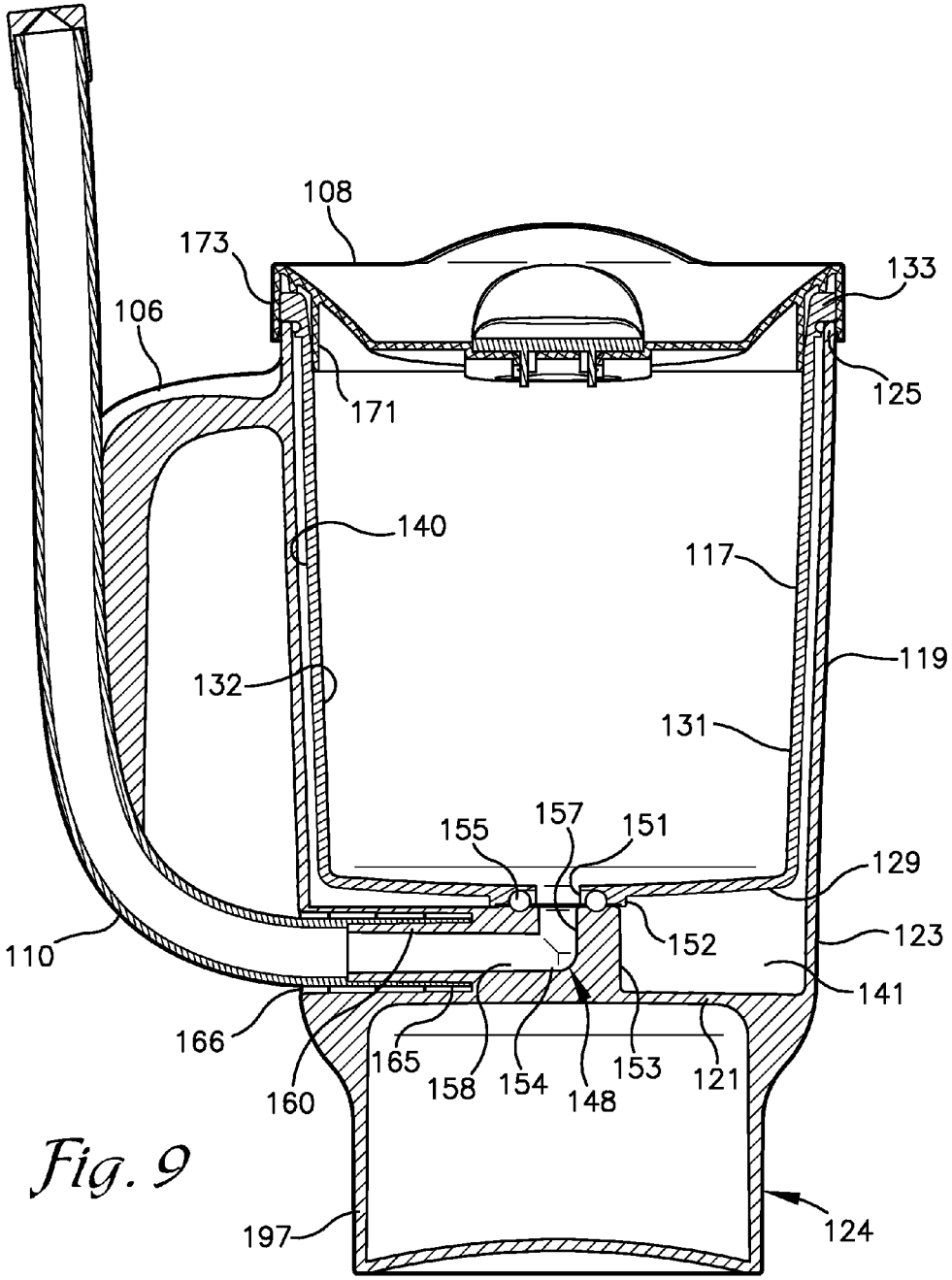
FIG. 9 is a cross-sectional view taken along line 9-9 of FIG. 8.
Figure 10:
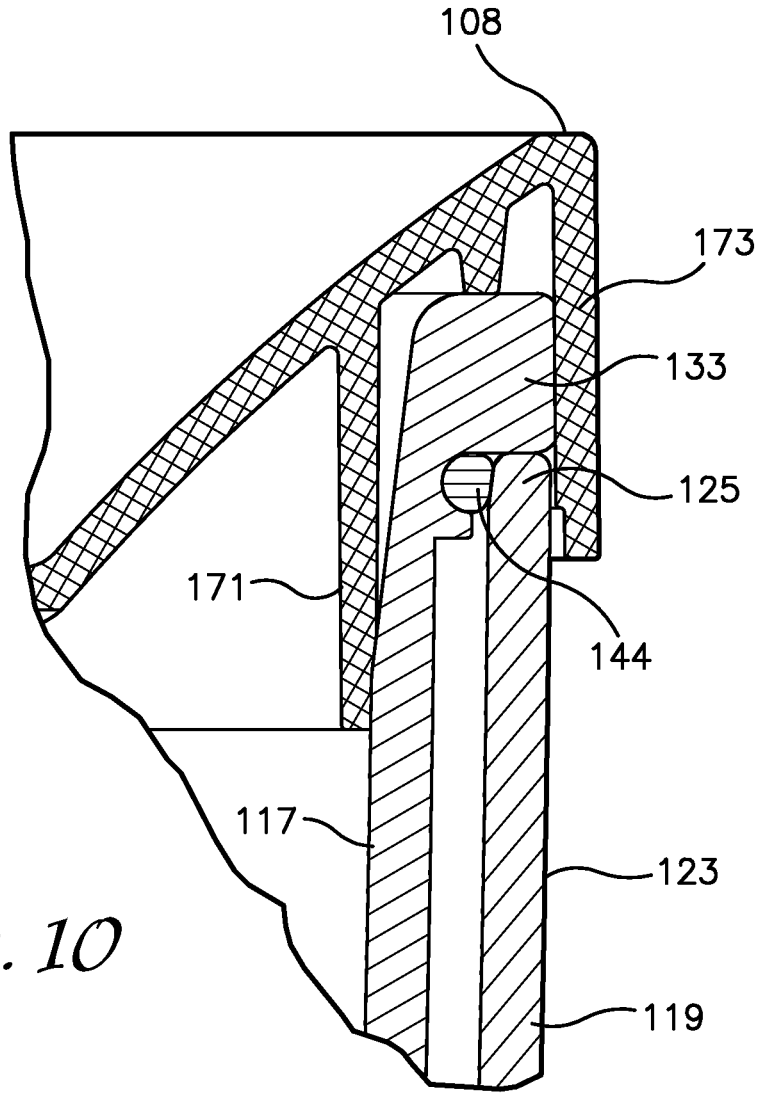
FIG. 10 is an enlarged and fragmentary cross-sectional view similar to FIG. 9 showing additional detail thereof.

It is also foreseen that an opening could be formed in the lid with a hinged or sliding cover to close the opening when not in use. An example of such an embodiment 101 is shown in FIGS. 8-10. The cup 101 shown in FIGS. 8-10 is adapted for use with a conventional sized cup holder such as may be found in an automobile or furniture. The construction of cup 101 is similar to that of cup 1 with the primary differences discussed below.

The drinking cup 101 includes a cup body 104, a handle 106, a lid 108 and a straw 110 flow connected to the cup body 104 near a base 112 thereof. Straw 110, in the embodiment shown, is a tube or hose formed from flexible elastomeric or plastic material such as latex or silicone. The cup body 104 is of double walled construction formed from an inner cup 117 removably securable within an outer cup 119. The inner and outer cups 117 and 119 are preferably formed from a relatively rigid and clear plastic which is microwavable and dishwasher safe and which is readily sterilizable.

The outer cup 119 includes a bottom or floor 121 and a circumferential outer cup side wall or outer side wall 123 and a cylindrical foot 124 of reduced diameter projecting downward from the floor or bottom panel 121. The outer side wall 123 and foot 124 are integrally formed with bottom 121. Outer side wall 123 extends upwardly from bottom 121 ending at outer side wall rim 125. The outer cup side wall 123 is generally cylindrical, however in the embodiment shown, the side wall 123 tapers inward slightly toward the bottom 121. The circumference of the upper portion of the outer side wall 123 is slightly larger than that of the lower portion. The foot 124 extends downward from the bottom 121 and is of reduced diameter and sized for reception in a conventional sized cup holder.

The inner cup 117 includes a bottom or floor 129 and a circumferential inner cup side wall or inner side wall 131 which form or surround a cup cavity or chamber 132 for receiving beverages or other consumable fluids. The inner side wall 131 is integrally formed with floor 129 and extends upwardly therefrom ending at rim 133. The rim 133 on the inner cup 117 projects outward and extends over the rim 125 of the outer cup 119. Similar to the outer cup 119, the inner side wall 131 is generally cylindrical with an inward taper toward the floor 129.

The inner cup 117 may be threadingly secured within the outer cup 119 as with cup 1. Alternatively, rim 133 of inner cup 117 may be sonically welded to side wall rim 125 to secure the inner and outer cups 117 and 119. Inner side wall 131 is offset from outer side wall 123 to form an air gap 140. The air gap 140 forms an insulating layer between the liquid in the cup and the air surrounding the cup. The inner side wall 131, air gap 140, and outer side wall 123 all form the double wall assembly that provides the thermal insulation benefits mentioned above. Similarly, a substantial portion of inner floor 129 is offset from outer floor 121 to form an air gap 141 therebetween. The inner floor 129, air gap 141, and outer floor 121 thermally insulate the bottom of the cup.

An elastomeric sealing member or O-ring 144 is shown secured around the outer surface of the inner cup side wall 131 just below rim 133. The O-ring 44 is compressed against an inner surface of outer cup side wall 123 when inner cup 117 is secured within outer cup 119 forming a water tight seal therebetween. It is to be understood that when the inner cup 117 is sonically welded to the outer cup 119, O-ring 144 may be unnecessary.

As best seen in FIG. 9, an outlet conduit 148 is formed in and through the inner cup 117 and outer cup 119. Inner cup outlet opening 151 is formed through the center of floor 129 of inner cup 117 and surrounded by outlet hub 152. As shown in FIG. 9, inner floor 129 slopes slightly toward outlet 151 to aid in evacuation of the contents due to gravity. When the cup body 104 is not closed by lid 108 and the valve on the end of straw 110 is open, the contents may flow through outlet 151 in large part due to the force of gravity and the head pressure created by the height of the liquid in inner cup 117. When the cup body 104 is closed by lid 108 an additional vacuum force from a person sucking on straw 110 will also assist in moving the contents through outlet 151 and out through straw 110.

A mount or pedestal 153 with an outlet passageway 154 extending therethrough is formed on and projects upward from the floor 121 of the outer cup 119 for connection with the outlet hub 152 on inner cup 117 in flow communication therewith. An elastomeric O-ring 155 is secured within a groove formed in a bottom surface of outlet hub 152 around the outlet opening 151 of inner cup 117. The O-ring is pressed against an upper surface of the pedestal 153 around the outlet passageway 154 to form a water tight seal between the inner cup 117 and outer cup 119 around the inner cup outlet 151 and the outer cup outlet passageway 154. It is to be understood that the outlet hub 152 may be sonically welded to the pedestal 153, in which case an O-ring would not be necessary.

Outlet passageway 154 in outer cup 119 is formed as a cylindrical bore through or molded into pedestal 153. Outlet passageway 154 includes a ninety degree bend with a vertical leg 157 of the passageway 154 communicating with outlet 151 in inner cup 117 and a horizontal leg 158 extending through the pedestal 153 and a nipple 160 projecting radially outward from the pedestal 153 through a larger, straw receiving bore 166 formed in the pedestal 153 and extending from the sidewall 123 of outer cup 119 toward the center of the cup 101. A first or inner end 165 of the flexible straw 110 is pressed onto and secured on the nipple 160 to couple straw 110 with flow passageway 154 which is flow connected to the interior or cavity 132 of inner cup 117 through inner cup outlet opening 151. The nipple 160 and the associated coupled end of straw 110 are concealed within the straw receiving bore 166.

The handle 106 shown is constructed and located similar to handle 6 of cup 1 and is adapted for securing straw 110 thereto in a similar fashion as handle 6 of cup 1.

Lid 108 is of a type adapted to be secured to cup 101 by a pressure fit between depending flanges 171 and 173 on lid 108 and the inner and outer sidewalls 131 and 123 of the cup body 104. Lid 108 may be of a type having a slide latch 175 operable by a user to selectively open or close an opening 177 through the lid 108. The lid 108 may also be of the type having an upstanding portion 179 on the rim adjacent the opening 177 to provide structure around which a user may place their lips to facilitate drinking. A vent hole 195 is preferably formed in the lid to allow a user to sip contents through the straw 110 as with the lid 8 for cup 1. The opening 177 in the lid 108 may be sized to allow a user to sip hot liquids, such as coffee therethrough or to drink through the top of the cup 101 if it is not desired to use the straw 110 or even to fill the cup 1 without having to remove the lid 108.

Cylindrical foot 124 of outer cup 119 forms part of the base 112. The base of the cup generally refers to any portion of the cup body 104 below the floor 129 of the inner cup 117 and may include the floor 129. Cylindrical foot 124 is formed from a cylindrical sidewall 197 that is narrower in diameter than the outer sidewall 123 of the cup body 104. Foot 124 is sized for generally snug reception within a cup holder with the straw 110 positioned above the top of the cup holder.

Figure 11:
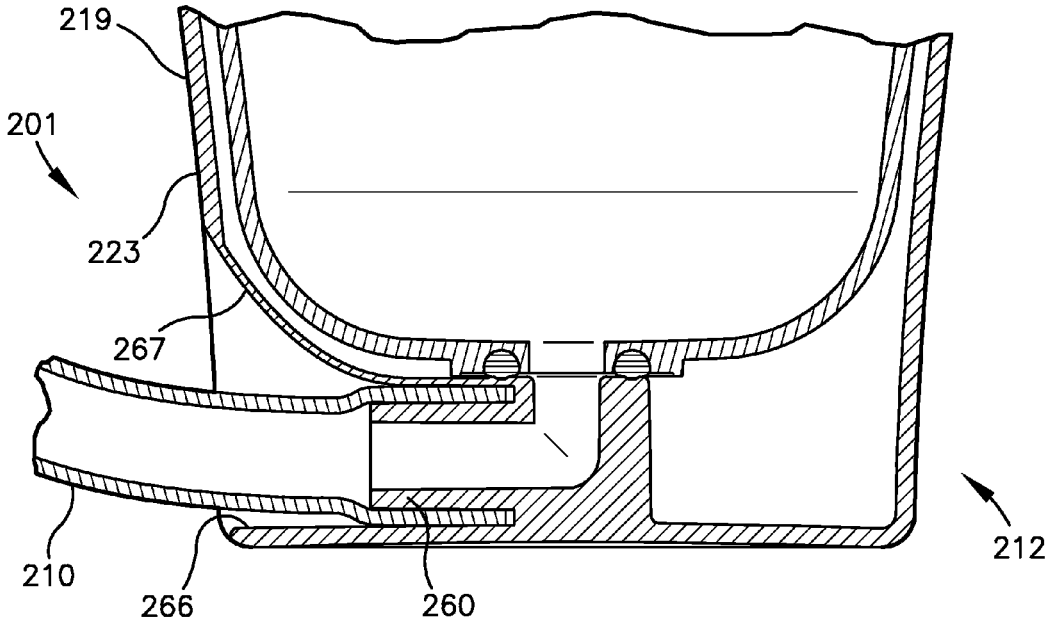
FIG. 11 is an enlarged and fragmentary cross-sectional view similar to FIG. 3 showing the base of a further alternative embodiment of a drinking cup and straw connected thereto.

Referring to FIG. 11, a cross-sectional view of the base of another embodiment of a drinking cup 201 is shown which is otherwise of similar construction as either cups 1 or 101. An outer diameter of the base 212 may be sized for reception in a cup holder. A straw receiving opening 266 formed in the base 212 and extending from the sidewall 223 of outer cup 219 toward the center of the cup 201 and around the nipple 260 is shaped to allow the straw 210 to be bent upward relative to the base 212 when the cup 201 is inserted in a cup holder. More specifically, an upper surface or edge 267 of the base 212 surrounding the straw receiving opening 266 curves or slopes upward and outward from the nipple 260 toward the outer sidewall 223. The upward curvature of the base 212 surrounding the straw receiving opening 266 reduces the likelihood that the straw 210 will be pulled off of the nipple 260 when the cup 201 is inserted in a cup holder.

It is to be understood that while certain forms of the present invention have been illustrated and described herein, it is not to be limited to the specific forms or arrangement of the parts described and shown.

Having thus described the invention, what is claimed as new and desired to be secured by this patent is as follows:

1. A cup comprising:

a cup body having a side wall and a base, said side wall extending upwardly from said base and surrounding an interior cavity for holding liquid, said cup body having an interior cavity outlet formed through said base in flow communication with said interior cavity;

a flexible straw connected to said cup body in flow communication with said interior cavity through said outlet;

a handle attached to said body, said handle shaped to receive said flexible straw and releasably secure said flexible straw thereto, wherein said handle includes a grip extending in spaced relation from said cup body; said grip having a semi-circular recess formed therein having a diameter closely approximating a diameter of said flexible straw and a portion of said semi-circular recess having a cross sectional arc greater than one hundred and eighty degrees.

2. The cup as in claim 1 wherein said semi-circular recess formed in said grip extends along a length of said grip.

3. The cup as in claim 1 wherein said flexible straw is connected to said cup body below a lower end of said grip.

4. The cup as in claim 1 wherein said handle is connected to said cup body proximate an upper end thereof and said grip extends downward and in spaced relation from said cup body.

5. The cup as in claim 1 wherein said flexible straw is flow connected with said interior cavity of said cup body through a side wall outlet in said side wall of said cup body and said handle is radially aligned with said side wall outlet.

6. The cup as in claim 5 further comprising a barbed nipple recessed in said cup body and connected to said cup body in flow communication with said interior cavity, and an inlet end of said flexible straw is removably securable around said nipple and said barbed nipple extends in radial alignment with said handle.

7. The cup as in claim 1 further comprising a lid removably securable to an upper end of said body in covering relationship with said interior cavity, said lid having a vent hole extending therethrough.

8. The cup as in claim 1 further comprising a bite actuated mouthpiece connected to an outlet end of said flexible straw, said bite actuated mouthpiece advanceable from a normally closed alignment, preventing liquid from flowing out the outlet end of said flexible straw, to an open alignment when squeezed to allow liquid to flow out the outlet end of the flexible straw.

9. A cup comprising:

a cup body including:

an outer cup comprising an outer cup side wall and an outer cup base, said outer cup side wall extending upwardly from said outer cup base; said outer cup base having a flow passageway formed therein;

an inner cup comprising an inner cup side wall and an inner cup base, said inner cup side wall extending upwardly from said inner cup base and forming an interior cavity for holding liquid, said inner cup having an outlet formed therethrough proximate said base;

said inner cup received within said outer cup, such that said outlet is aligned in flow communication with said flow passageway formed in said outer cup base, portions of said inner cup being spaced from said outer cup to form an insulating layer therebetween;

a flexible straw connected to said cup body in flow communication with said flow passageway.

10. The cup as in claim 9 wherein a sealing member is positioned between said inner cup and said outer cup around said outlet and the inlet to said flow passageway.

11. The cup as in claim 9 further comprising a nipple connected to and recessed within said outer cup base in flow communication with said interior cavity through said flow passageway and said outlet, and an inlet end of said flexible straw is removably securable around said nipple.

12. The cup as in claim 9 further comprising a lid removably securable to an upper end of said body in covering relationship with said interior cavity, said lid having a vent hole extending therethrough.

13. The cup as in claim 9 further comprising a bite actuated mouthpiece connected to an outlet end of said flexible straw, said bite actuated mouthpiece advanceable from a normally closed alignment, preventing liquid from flowing out the outlet end of said flexible straw, to an open alignment when squeezed to allow liquid to flow out said outlet end of said flexible straw.

14. The cup as in claim 9 further comprising a handle attached to said body, said handle shaped to receive said flexible straw and releasably secure said flexible straw thereto.

15. The cup as in claim 14 wherein said handle includes a grip extending in spaced relation from said cup body; said grip having a semi-circular recess formed therein having a diameter closely approximating a diameter of said flexible straw and a portion of said semi-circular recess having a cross sectional arc greater than one hundred and eighty degrees.

16. The cup as in claim 15 wherein said flexible straw is flow connected with said interior cavity of said cup body through a side wall outlet extending through said outer cup side wall of said cup body and said handle is radially aligned with said side wall outlet.

17. The cup as in claim 15 wherein said semi-circular recess formed in said grip extends along a length of said grip.

18. A cup comprising:

a cup body including:

an outer cup comprising an outer cup side wall and an outer cup base, said outer cup side wall extending upwardly from said outer cup base; said outer cup base having a flow passageway formed therein;

an inner cup comprising an inner cup side wall and an inner cup base, said inner cup side wall extending upwardly from said inner cup base and forming an interior cavity for holding liquid, said inner cup having an outlet formed therethrough proximate said base;

said inner cup received within said outer cup, such that said outlet is aligned in flow communication with said flow passageway formed in said outer cup base, portions of said inner cup being spaced from said outer cup to form an insulating layer therebetween;

a flexible straw connected to said cup body in flow communication with said flow passageway;

a handle attached to said body, said handle including a grip extending in spaced relation from said cup body; said grip having a semi-circular recess formed therein having a diameter closely approximating a diameter of said flexible straw and a portion of said semi-circular recess having a cross sectional arc greater than one hundred and eighty degrees; said semi-circular recess adapted to receive said flexible straw and releasably secure said flexible straw thereto.

19. A cup comprising:

a cup body including:

an outer cup comprising an outer cup side wall and an outer cup bottom, said outer cup side wall extending upwardly from said outer cup bottom; said outer cup having a flow passageway formed therein;

an inner cup comprising an inner cup side wall and an inner cup bottom, said inner cup side wall extending upwardly from said inner cup bottom and forming an interior cavity for holding liquid, said inner cup having an outlet formed through said inner cup bottom;

said inner cup received within said outer cup, such that said outlet is aligned in flow communication with said flow passageway formed in said outer cup, portions of said inner cup being spaced from said outer cup to form an insulating layer therebetween;

a flexible straw connected to said cup body in flow communication with said flow passageway.

* * * * *